United States Patent [19]

Seaman

[11] Patent Number: 4,461,197

[45] Date of Patent: Jul. 24, 1984

[54] METHODS OF AND APPARATUS FOR DISPENSING AND POSITIONING TAPE ONTO A SURFACE

[75] Inventor: Gary G. Seaman, Broomfield, Colo.

[73] Assignee: AT&T Technologies, Inc., New York, N.Y.

[21] Appl. No.: 334,274

[22] Filed: Dec. 24, 1981

[51] Int. Cl.[3] ..... B26D 7/06

[52] U.S. Cl. ..... 83/152; 83/112

[58] Field of Search ..... 83/23, 24, 100, 112, 83/152, 167, 277, 922

[56] References Cited

U.S. PATENT DOCUMENTS

| | | | |
|---|---|---|---|
| 3,159,325 | 12/1964 | Toensing | 83/152 |
| 3,353,432 | 11/1967 | Philippi | 83/922 |
| 3,431,827 | 3/1969 | Wahle et al. | 83/152 |
| 3,586,586 | 6/1971 | Berg | 83/152 |
| 3,587,376 | 6/1971 | Hirano | 83/922 |
| 3,721,375 | 3/1973 | Roberts et al. | 83/152 |
| 3,754,491 | 8/1973 | Tange et al. | 83/922 |
| 4,036,087 | 7/1977 | Braun | 83/152 |
| 4,149,484 | 4/1979 | Koch | 83/152 |
| 4,356,054 | 10/1982 | Gotz | 83/277 |

*Primary Examiner*—E. R. Kazenske
*Assistant Examiner*—Paul M. Heyrana, Sr.
*Attorney, Agent, or Firm*—R. F. Kip, Jr.

[57] ABSTRACT

A section (21) of tape (20), having an adhesive side (22), is advanced from a roll (18) and is held tautly beneath a plurality of tubes (86). The section (21) of tape (20) is vacuumly gripped on the adhesive side (22) by the tubes (86) and is thereafter severed from the roll (18). The tubes (86) are then moved to accurately place the severed section (21) of the tape (20) onto a tape support surface (44). Vacuum is removed from the tubes (86) and is applied to the surface (44) to facilitate the transfer of the severed section (21) of the tape (20) to the surface.

3 Claims, 16 Drawing Figures

METHODS OF AND APPARATUS FOR DISPENSING AND POSITIONING TAPE ONTO A SURFACE

TECHNICAL FIELD

This invention relates to methods of and apparatus for dispensing and positioning tape onto a surface and particularly to methods of and an apparatus for dispensing a selected length of adhesive tape from a roll and positioning the selected length of tape onto a surface.

BACKGROUND OF THE INVENTION

In some manufacturing operations, a plurality of small elements, such as foil inlays for printed circuits, must be assembled in close uniform or nonuniform spacing relative to one another for ultimate transfer to a permanent site. Due to the close spacing and the relative size of the elements, it becomes difficult to manually manipulate each element while maintaining the spacing therebetween. One method of facilitating the assembly of the plurality of elements in a desired spacing is to adhere the elements to a piece of adhesive tape for ultimate transfer to the permanent site. However, during the handling of the tape in preparation for transfer of the elements thereto, the tacky side of the tape could become attached undesirably to surrounding structure.

U.S. Pat. No. 3,159,325 which issued to J. W. Toensing discloses a taping apparatus. Tape, from a supply roll, is threaded between two sets of clamps, one set being fixed to the apparatus and the other set being movable relative to the other set. The coordinated movement of the clamps serves to advance a leading section of the tape in a single direction through and beyond the fixed set of clamps. The tape is then held by the fixed set of clamps with the leading section being unclamped beyond the fixed set of clamps. The leading section is then severed from the clamped portion of the tape. As the leading section is being severed from the tape, the nontacky side of the tape is vacuumly gripped. Thereafter, the vacuumly gripped section is transferred to and pressed against an article to which it is to be adhered. It is noted that the leading edge of the tape is unclamped prior to severing thereof. Therefore, it would appear that there is a lack of alignment control for the leading section which could result in a loss of accuracy in placement of the leading section with the article. Consequently, there is a need for methods of and apparatus for dispensing and accurately positioning tape onto a surface.

SUMMARY OF THE INVENTION

This invention relates to methods of and apparatus for dispensing and positioning tape from a roll onto a surface. A selected length of tape is advanced and is held taut. The tautly held selected length is then gripped on one side thereof. The tautly held selected length is severed so that the gripped selected length is separated from the roll. Thereafter, the severed length of tape is transferred to the surface so that an opposite side of the tape is placed in engagement with the surface.

DETAILED DESCRIPTION

Figure 1:
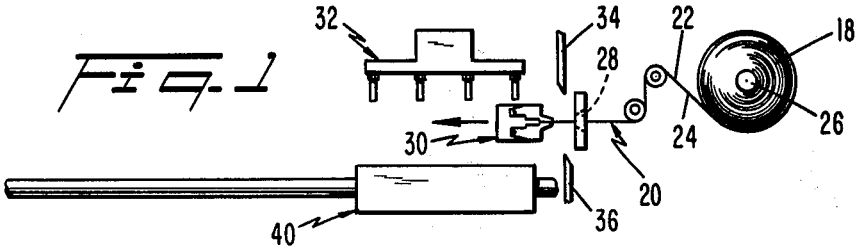
FIGS. 1 through 6 are diagramatic views of an apparatus for dispensing and positioning tape onto a surface embodying certain principles of the invention.
Figure 2:
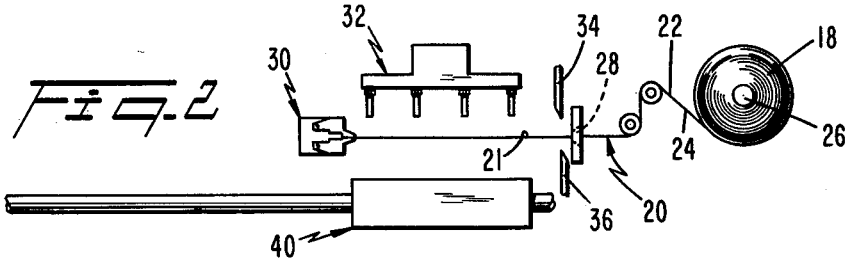
Figure 3:
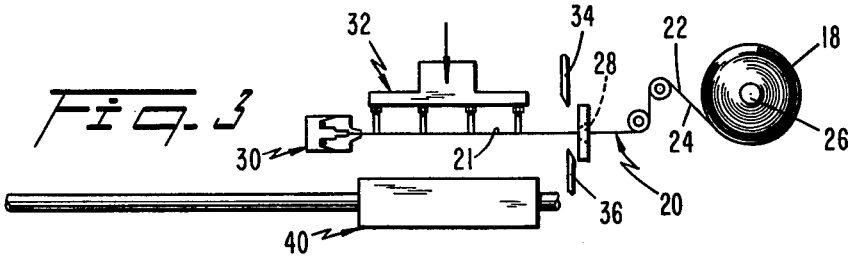

Referring to FIG. 1, a roll 18 of adhesive tape, designated generally by the numeral 20, having an adhesive side 22 and a nonadhesive side 24 is mounted onto a mandrel 26 so that the adhesive side 22 faces in an upward direction when the tape is unwound or dispensed from the roll. The tape 20 is threaded through a tapered aperture 28 and is gripped by a tape advancing system, designated generally by the numeral 30. The tape advancing system 30 is then moved to a second position to pull a section 21 of the tape 20 from roll 18. A tape vacuum pick-up system, designated generally by the numeral 32, is then moved to a position adjacent to section 21 of tape 20 as illustrated in FIGS. 2 and 3. Thereafter, the tape pick-up system 32 is moved to adhere the adhesive side 22 of section 21 of the tape 20 thereto.

Figure 4:
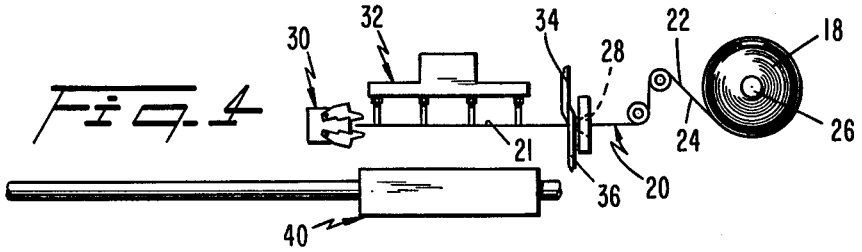
Figure 5:
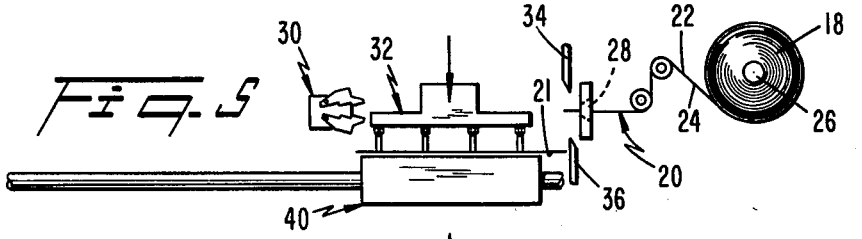
Figure 6:
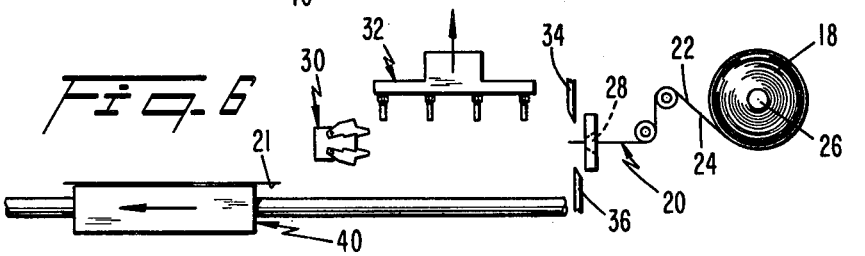

Referring to FIG. 4, the advancing system 30 releases section 21 of tape 20 and cutting blades 34 and 36, which are positioned above and below section 21 of the tape 20, respectively, are then activated to sever the section of tape from the remainder on roll 18. Thereafter, the tape vacuum pick-up system 32 transfers the severed section 21 of the tape 20 to a vacuum-gripping tape shuttle, designated generally by the numeral 40, as illustrated in FIG. 5. The tape vacuum pick-up system 32 releases the severed section 21 of the tape 20 and is returned to its original position (FIG. 1) while the shuttle 40 is moved to a position as illustrated in FIG. 6 whereat a plurality of elements (not shown) may be adhered to the adhesive side 22 of the severed section of tape. The severed section 21 of tape 20 with the adhered elements may then be removed for subsequent transfer to the permanent site of the elements. The elements could be, for example, foil overlays for application to printed circuit sections at the edge of a supporting board (not shown). Thereafter, the shuttle 40 is returned to the position illustrated in FIG. 1, and the process as illustrated in FIGS. 1 through 6 is repeated.

Figure 7:
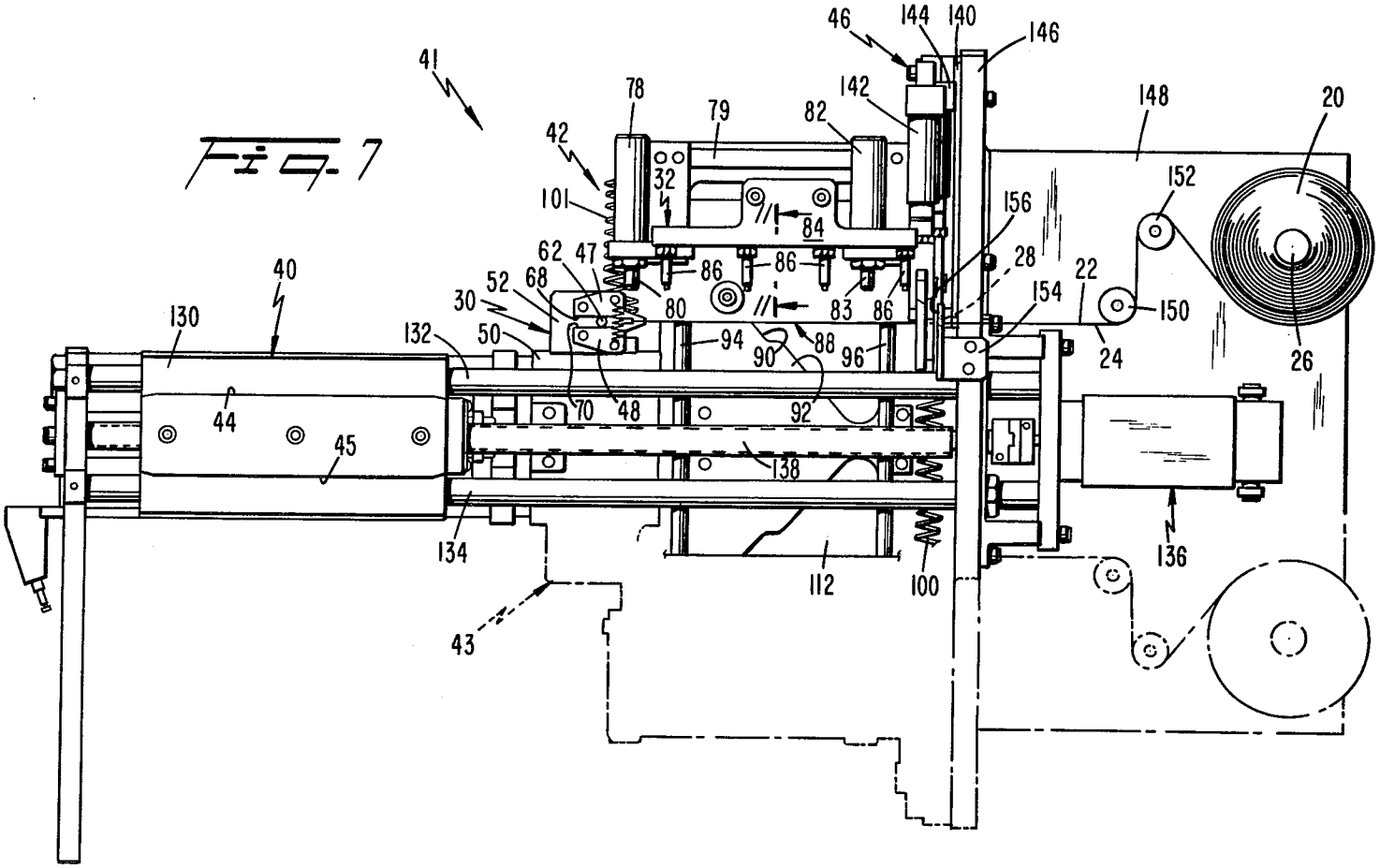
FIG. 7 is a front view of the apparatus of FIGS. 1 through 6 embodying certain principles of the invention.

Referring to FIG. 7, there is illustrated an apparatus, designated generally by the numeral 41, for dispensing and accurately positioning sections 21 (FIG. 1) of adhesive tape 20. The apparatus 41 includes an upper tape dispensing and positioning system, designated generally by the numeral 42, and a lower tape dispensing and positioning system designated generally by the numeral 43. The upper system 42 dispenses and positions a section 21 of adhesive tape 20 onto an upper vacuum surface 44 of the shuttle 40. The lower system 43 dispenses and positions a section 21 of adhesive tape 20 onto a lower vacuum surface 45 of the shuttle 40. The lower system 43 is a mirror image of the upper system 42 as viewed in FIG. 7. Thus, only the upper system 42 will be described herein. The upper system 42 includes (1) the tape advancing system 30, (2) the tape vacuum pick-up system 32, (3) the vacuum-gripping tape shuttle 40 and (4) a tape severing system 46.

Figure 9:
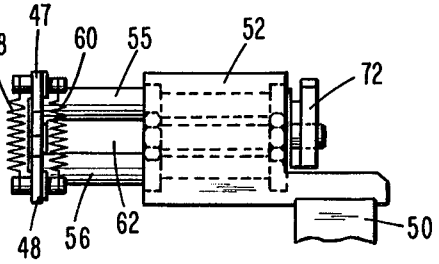
FIGS. 8 through 10 are views of a tape advancing system of the apparatus of FIGS. 1 through 6.
Figure 8:
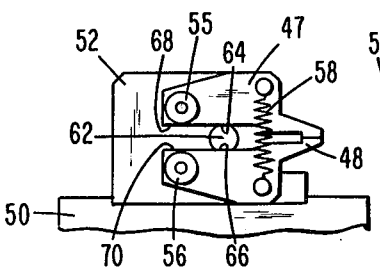
Figure 10:
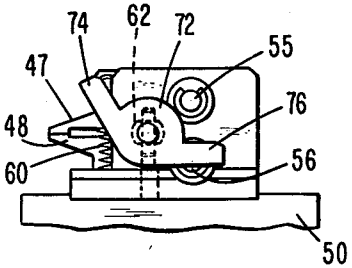
Figure 12:
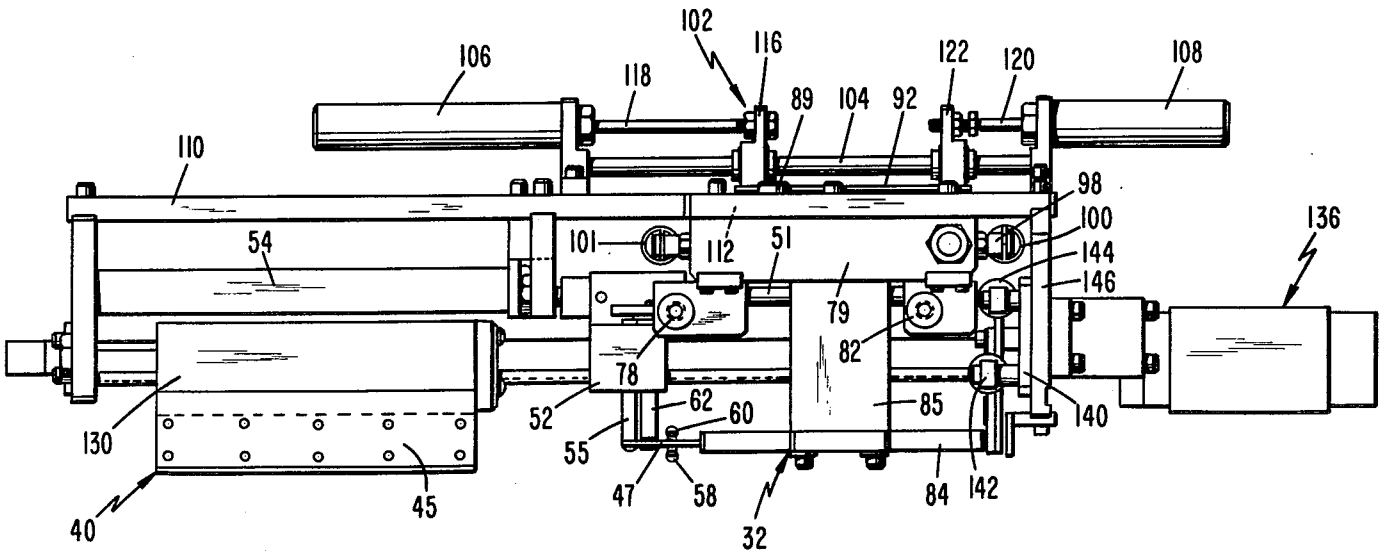
FIG. 12 is a plan view of the apparatus of FIG. 7.

The tape advancing system 30 includes a pair of gripping jaws 47 and 48 mounted on a carriage 50. The carriage 50 is mounted on two spaced shafts 51 (FIG. 12, one shown) for horizontal movement thereon. An air cylinder 54, which is fixedly attached to the carriage 50, facilitates the horizontal movement of the carriage on the shafts 51 (FIG. 12). Referring to FIGS. 8 and 9, the gripping jaws 47 and 48 are pivotally attached to a support member 52 by shafts 55 and 56, respectively. A pair of springs 58 and 60 bias the gripping jaws 47 and 48 in a direction toward each other. A substantially round rod 62 having two flat surfaces 64 and 66 formed in opposite surfaces thereof is positioned between gripping jaws 47 and 48. When the gripping jaws 47 and 48 are closed, as illustrated in FIGS. 7 and 8, flat surfaces 64 and 66 are positioned adjacent to inner surfaces 68 and 70, respectively, of the gripping jaws 47 and 48, respectively. The rod 62 extends through the support member 52 and is fixedly attached to an operating member 72 as illustrated in FIGS. 9 and 10. The operating member 72 has tow levers 74 and 76 extending therefrom.

Referring again to FIG. 7, to open the gripping jaws 47 and 48, air cylinder 78, which is mounted on bracket 79, is activated which extends plunger 80. Plunger 80 contacts and rotates lever 74 (FIG. 10) of the operating member 72 about the rod 62. As noted above, rod 62 is fixedly attached to the operating member 72 and therefore is rotated therewith. This rotation of the rod 62 causes the inner surfaces 68 and 70 of gripping jaws 47 and 48, respectively, to come in contact with the rounded portions of the rod which forces the gripping jaws to open and to be locked in this open position. Thereafter, to close the gripping jaws 47 and 48, the operating member 72 must be positioned below air cylinder 82 which is then activated and plunger 83 is extended. Plunger 83 contacts and rotates lever 76 (FIG. 10) of the operating member 72 about rod 62. The rotation of lever 76 is this manner facilitates (1) the return of the flat surfaces 64 and 66 to a position adjacent inner surfaces 68 and 70, respectively, and (2) the closing of gripping jaws 47 and 48.

Figure 11:
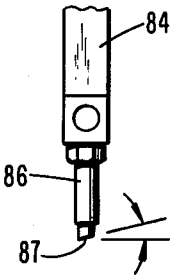
FIG. 11 is a side view of a vacuum head of the apparatus of FIG. 7.

The tape pick-up system 32 includes a vacuum head 84 having a plurality of tubes 86 attached thereto. Each of the plurality of tubes 86 is designed to have minimum contact with the adhesive side 22 of the tape 20. This is accomplished by constructing each of the plurality of tubes 86 to have small diameters and thin walls. Each of the plurality of tubes 86 may be designed to have a slight angle formed into a lower surface 87 as illustrated in FIG. 11. Although only one embodiment of the tubes 86 is illustrated in FIG. 11, it is to be understood that tubes without the angle will also facilitate minimum contact so long as the tubes have small diameters and thin walls. Thus, by reducing the contact area between the adhesive side 22 of the tape 20, the ease of release of tape from the plurality of tubes 86 is greatly facilitated. The vacuum head 84 is coupled to a connecting member 85 and a linear sliding system, designated generally by the numeral 88. The linear sliding system 88 has a cam follower 89 (FIG. 13) attached to a back side thereof which rides along one edge 90 of a cam plate 92. The linear sliding system 88 is mounted for vertical movement on two spaced vertical shafts 94 and 96. The linear sliding system 88 includes a bolt assembly 98 (FIG. 13) for supporting an upper end of an extension spring 100. A lower end of the extension spring 100 is coupled to a bolt assembly (not shown) which is fixedly attached to a bracket (not shown) included in the lower tape dispensing and positioning system 43. The extension spring 100 biases downwardly the linear sliding system 88 and the vacuum head 84 as viewed in FIG. 7. Extension spring 101 facilitates the movement of another linear sliding system (not shown) which is a part of the lower system 43.

Referring to FIG. 12, the cam plate 92 is fixedly attached to a linear system, designated generally by the numeral 102. The linear system 102 is mounted on a shaft 104 for horizontal movement thereon. Air cylinders 106 and 108 facilitate the horizontal movement of the linear system 102 and the cam plate 92 attached thereto. The air cylinders 106 and 108 are fixedly attached to a back member 110 of the apparatus 41. The back member 110 includes a cut-out portion 112 through which the cam follower 89 extends and contacts edge 90 of the cam plate 92 as illustrated in FIG. 13.

Figure 13:
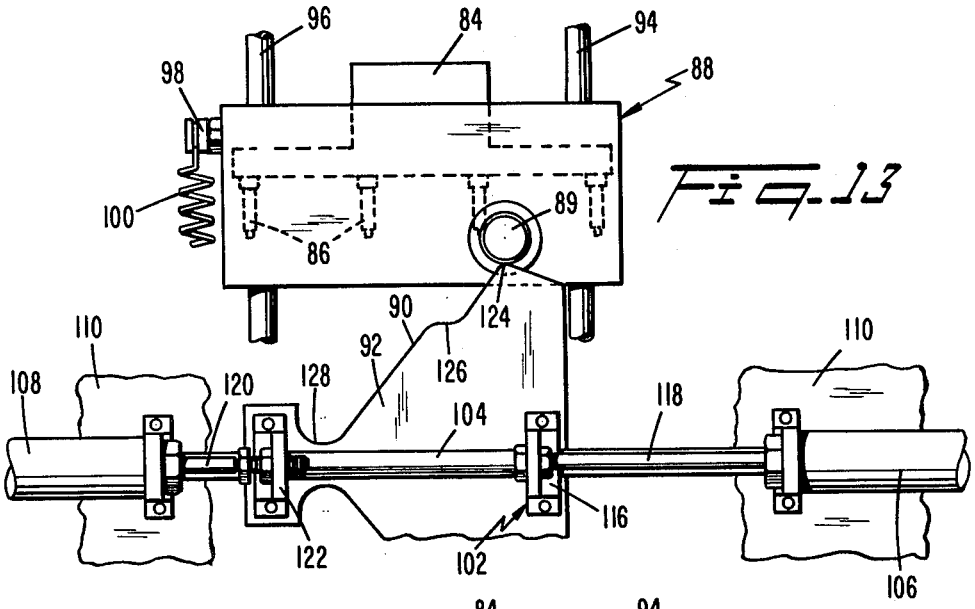
FIGS. 13 through 15 are partial rear views of the apparatus of FIG. 7.
Figure 14:
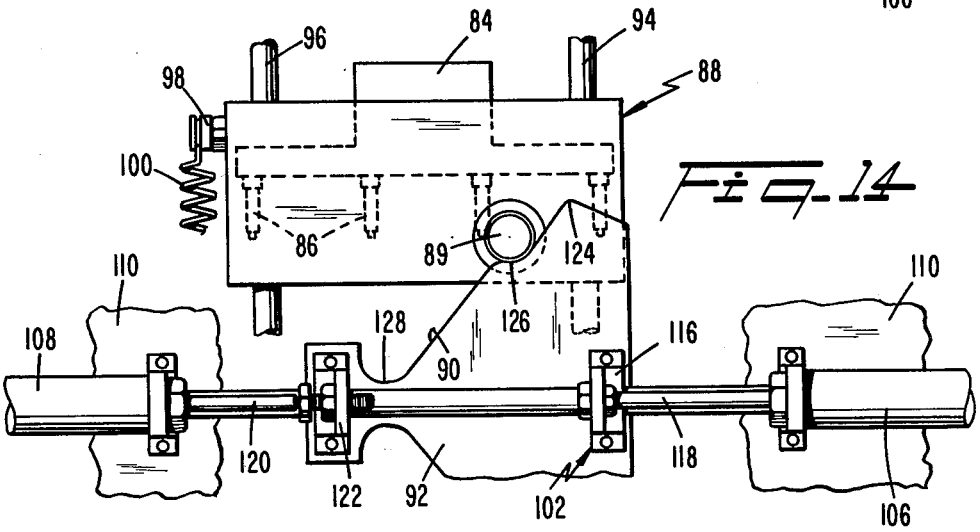
Figure 15:
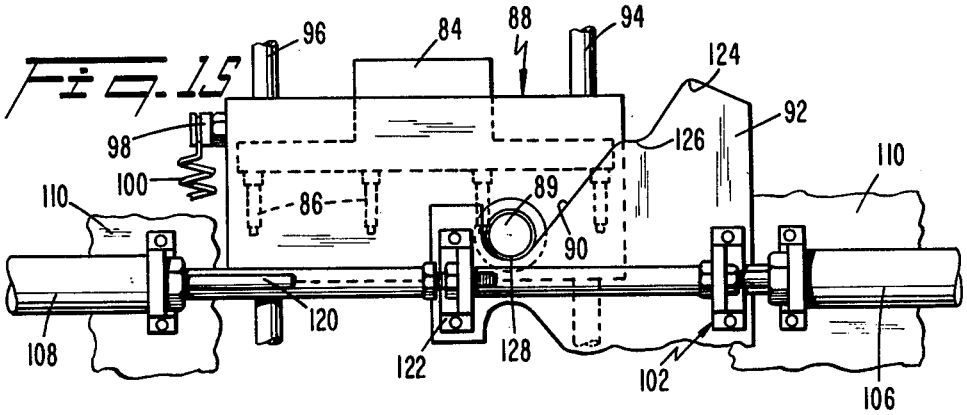

Referring to FIG. 13, as viewed from the rear of the upper system 42 with portions broken away for clarity, the cam follower 89 contacts edge 90 of the cam plate 92. As noted above, air cylinders 106 and 108 facilitate the vertical movement of the linear sliding system 88. A stand 116 of the linear system 102 is fixedly attached to a plunger 118 of the air cylinder 106. Plunger 120 of air cylinder 108 is positioned to contact a stand 122 of the linear system 102 but is not fixedly attached thereto. When air cylinder 106 facilitates locating the cam follower 89 on lobe 124 of cam plate 92, the vacuum head 84 is positioned as illustrated in FIGS. 1, 2, 7 and 13. To move the cam follower 89 to ledge 126 of cam plate 92, air cylinder 108 is activated which facilitates horizontal movement of (1) the cam plate 92 and (2) vertical movement of the vacuum head 84 as illustrated in FIGS. 14 and 3, respectively. Air cylinder 106 is then activated to further move cam plate 92 horizontally until cam follower 89 is located in depression 128 of the cam plate as illustrated in FIG. 15. The position of the vacuum head 84 associated with this movement of the cam follower 89 is illustrated in FIG. 5. Thereafter, air cylinder 106 is once again activated to move the cam plate 92 horizontally in the opposite direction to return the cam follower 89 to the position on lobe 124 and the vacuum head 84 to its uppermost position as illustrated in FIGS. 7 and 13.

Referring again to FIG. 7, the shuttle 40 includes the upper and lower vacuum surfaces 44 and 45 attached to a linear sliding system 130. The linear sliding system 130 is mounted onto two spaced shafts 132 and 134 for horizontal movement thereon. A motor-encoder system, designated generally by the numeral 136, coupled to a screw drive 138 and a ball nut (not shown) facilitates the horizontal movement of the linear sliding system 130.

Figure 16:
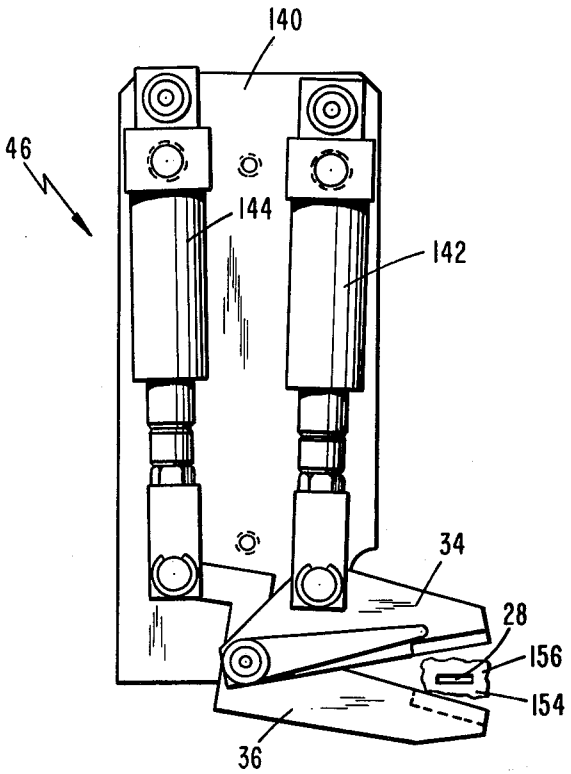
FIG. 16 is a side view of a tape severing system of the apparatus of FIG. 7.

Referring to FIG. 16, the tape severing system 46 includes a support member 140 having the cutting blades 34 and 36 mounted for pivotal movement thereon. Air cylinders 142 and 144, which are also mounted on support member 140, are coupled to and operate cutting blades 34 and 36, respectively. When the cutting blades 34 and 36 are in an open position, as illustrated in FIG. 16, tape 20, which is fed through tapered aperture 28, is positioned therebetween. The support member 140 is fixedly attached to a vertical member 146 (FIGS. 7 and 12) of the upper tape dispensing and positioning system 42 as illustrated in FIG. 7.

Referring again to FIG. 7, a support plate 148 is also fixedly attached to the vertical member 146. The support plate 148 includes the mandrel 26 and a pair of idler pulleys 150 and 152 mounted thereon. Idler pulley 150 is positioned so that as the tape 20 egresses from the pulley, the tape is tangent to the tapered aperture 28 formed in a tape-guide plate 154. Tape-guide plate 154 is also secured to the vertical plate 146.

In use, the roll of adhesive tape 20 is mounted onto the mandrel 26 of the upper dispensing and positioning system 42. Section 21 of the tape 20, which is unwound so that the adhesive side 22 faces in an upwardly direction, is threaded (1) over idler pulley 152, (2) under idler pulley 150 and through the tapered aperture 28 until approximately three-eights of an inch protrudes on an opposite side 156 of the tape-guide plate 154. Section 21 of the tape 20 is held in this position by adhering the adhesive side 22 to an upper surface of the aperture 28. Air cylinder 54 (FIG. 7) then moves the carriage 50, having gripping jaws 47 and 48 mounted thereon, to a right-most position as viewed in FIG. 1. The gripping jaws 47 and 48, which are in the open position, are located so that they are contiguous with side 156 of the tape-guide plate 154 and so that gripping jaw 47 is positioned above the adhesive side 22 of section 21 of the tape 20 while gripping jaw 48 is positioned below the nonadhesive side 24 of the tape. Air cylinder 82 is then activated which facilitates the closing of gripping jaws 47 and 48 capturing an edge of section 21 therebetween. Thereafter, air cylinder 54 (FIG. 11) is operated to move the carriage 50 horizontally to the left, as viewed in FIG. 7, so that lever 74 (FIG. 10) of the operating member 72 (FIG. 10) is positioned below air cylinder 78. A selected length of the tape 20, such as section 21, is advanced from the roll 18 and is held taut as a result of the movement of the carriage 50.

Air cylinder 108 (FIGS. 12 and 13) is activated to move the cam plate 92 horizontally to the left, as viewed in FIG. 7, thus moving the cam follower 89 (FIGS. 12 and 13) from lobe 124 to ledge 126 as illustrated in FIG. 14. This movement of the cam plate 92 facilitates the lowering of the vacuum head 84 having the plurality of tubes 86 attached thereto to a position so that tips of lower surfaces 87 (FIG. 11) are immediately above to the tautly held adhesive side 22 (FIG. 1) of the tape section 21 as illustrated in FIG. 3. Vacuum, which is associated with each of the plurality of vacuum tubes 86, is applied so that the adhesive surface 22 of the tape 20 becomes affixed to the lower surfaces 87 (FIG. 11) thereof. Thereafter, air cylinder 78 is activated to facilitate the opening of the gripping jaws 47 and 48. Gripping jaw 47, which contacts the adhesive side 22 of tape section 21, is purposely designed to have a relatively small contact area with the adhesive side of the tape. When gripping jaws 47 and 48 are opened, the adhesive side 22 of tape section 21 is released therefrom. Moreover, due to the small contact area of gripping jaw 47, the adhesive side 22 of tape section 21 is peeled from the gripping jaw without disturbing the position of the tape section being held by the plurality of tubes 86.

Air cylinder 142 is then activated to move cutting blade 34 downwardly to a stationary position adjacent and parallel to the adhesive side 22 of section 21. Air cylinder 144 is then operated which drives cutting blade 36 upwardly in a plane on the side of the cutting blade 34 facing the roll 18, as viewed in FIG. 7, to sever the section 21 from the tape 20. Since cutting blade 34 was held stationary during the severing of tape section 21 from the tape 20, there is no tendency for the tape to become displaced on the plurality of tubes 86. During the severing of section 21, the tape is forced into the cutting edge of blade 34 to prevent any portion of the severed section 21 from moving away from and laterally of the plane in which it is held by the tubes 86. Moreover, the tape section 21 is severed so that a three-eighths of an inch portion of the tape 20 protrudes from the tapered aperture 28 of the tape guide plate 154. Additionally, the adhesive side 22 of the three-eighths inch portion of tape 20 is affixed to the upper surface of the tapered aperture 28 due to the movement of cutting blade 36. Thereafter cutting blades 34 and 36 are returned to their open position as illustrated in FIGS. 5 and 16.

Air cylinder 106 (FIGS. 12 and 15) is then activated to move the cam plate 92 horizontally to the left, as viewed in FIG. 7, thus moving the cam follower 89 (FIGS. 12 and 15) to position 128 as illustrated in FIG. 15. This movement of the cam plate 92 facilitates the lowering of the vacuum head 84 so that the severed section 21 of the tape 20 which is affixed to lower surfaces 87 (FIG. 11) of the plurality of tubes 86 is positioned immediately above the upper vacuum surface 44 of the shuttle 40 as illustrated in FIG. 5. Thereafter, vacuum is applied to the upper vacuum surface 44 and is removed from the tubes 86 to facilitate transferring the severed section 21 of the tape 20 from the plurality of tubes to the upper vacuum surface. As soon as the transfer of the severed section 21 of the tape 20 is complete, air cylinder 106 is activated to move the cam plate 92 horizontally to the right, as viewed in FIG. 7, so that the cam follower 89 is moved to the position on lobe 124 as illustrated in FIG. 13. This movement of the cam plate 92 facilitates moving the vacuum head 84 to its uppermost position as illustrated in FIGS. 1, 6 and 7. Thereafter, the shuttle 40 is moved to a second position so that a plurality of elements (not shown) are automatically affixed to the adhesive surface 22 of the tape section 21 as illustrated in FIGS. 6 and 7.

While the preferred embodiment of the invention, as described hereinabove, is to dispense and accurately position severed section 21 of adhesive tape 20 onto vacuum surface 44 with the adhesive side 22 facing in an upwardly direction, the apparatus 41 will also dispense and accurately position a severed piece of adhesive tape onto a surface with the adhesive side facing in a downwardly direction. Moreover, while one embodiment of the invention has been described hereinabove, it will be obvious that various modifications may be made from the specific details described without departing from the spirit and scope of the invention.

What is claimed is:

1. A method of dispensing and positioning tape having an adhesive side from a roll onto a surface, which comprises the steps of:

(a) gripping a leading end of the tape adjacent to the roll;

(b) pulling the gripped leading end of the tape from the roll a selected distance to provide a selected length of tape;

(c) holding taut the selected length of the tape;

(d) gripping one side of the taut selected length of tape by means of:
moving a plurality of tubes attached to a position adjacent the adhesive side of the selected lenght of tape,
affixing the adhesive side of the selected length of tape to lower surfaces of each of the plurality of tubes, and
applying vacuum to each of the plurality of vacuum tubes;
(e) severing the gripped tautly-held tape so that the selected length of tape is separated from the roll; and
(f) transferring the severed length of tape to a surface so that the non-adhesive side of the tape is placed in engagement with the surface of a tape support where transferring includes the steps of:
moving the tubes having the severed length of tape affixed thereto to a position so that the non-adhesive side of the tape is placed in engagement with the surface of the tape support,
removing the vacuum from the tubes so that the selected length of tape is held by the adhesive side of the tape with the tubes, and
applying a vacuum to the tape support surface so that the severed length of the tape is transferred from the lower surfaces of each of the plurality of tubes to the tape support surface.

2. An apparatus for dispensing and positioning tape having an adhesive side from a roll onto a surface of a tape support, which comprises:
(a) first means for gripping a leading end of the tape adjacent to the roll;
(b) means for pulling the gripped leading end of the tape from the roll a selected distance to provide a selected length of tape;
(c) means for holding taut the selected length of the tape;
(d) second means for gripping one side of the taut selected length of the tape where the second means for gripping comprises:
a plurality of spatially arranged tubes,
means for moving the plurality of tubes to a position whereat lower surfaces of each of the plurality of tubes is affixed to the adhesive side of the selected length of tape, and
means for applying vacuum to each of the plurality of tubes;
(e) means for severing the gripped tautly-held tape so that the selected length of tape is separated from the roll; and
(f) means for transferring the severed length of tape to the surface of the tape support so that the non-adhesive side of the tape is placed in engagement with the surface of the tape support where the means for transferring comprises:
means for moving the tubes having the severed length of tape affixed thereto to a position so that the non-adhesive side of the tape is placed in engagement with the surface of the tape support,
means for removing the vacuum from the tubes so that the selected length of tape is held by the adhesive side of the tape with the tubes, and
means for applying a vacuum to the tape support surface so that the severed length of the tape is transferred from the lower surfaces of each of the plurality of tubes to the tape support surface.

3.
An apparatus for dispensing and positioning tape having an adhesive side from a roll onto a surface of a tape support, which comprises:
means for gripping a leading end of tape adjacent to the roll;
means for pulling the gripped end of the tape from the roll a selected distance to provide a selected length of tape;
means for holding taut the selected length of the tape from the roll;
a plurality of spatially arranged tubes;
means for moving the plurality of tubes to a first position whereat lower surfaces of each of the plurality of tubes is affixed to the adhesive side of the selected length of tape;
means for applying vacuum to each of the plurality of tubes;
a first cutting blade having a cutting surface;
a second cutting blade positioned spatially from the first cutting blade and in a plane which extends from the side of the first cutting blade which faces the roll;
means for moving the first cutting blade to a stationary position adjacent to the adhesive side of the selected length of tape with the cutting surface thereof being substantially in the plane of the lower surfaces of the tubes;
means for moving the second cutting blade in the direction of the first cutting blade to sever the tape wherein the positioning of the second cutting blade in the plane on the side of the first cutting blade precludes the severed length of tape from moving away from and laterally of the plane of the lower surfaces of the tubes;
means for moving the tubes having the severed length of tape affixed thereto to a second position so that the opposite side of the tape is placed in engagement with the surface of the tape support;
means for removing the vacuum from the tubes so that the severed length of tape is held by the adhesive side of the tape with the tubes; and
means for applying a vacuum to the tape support surface so that the severed length of tape is transferred from the lower surfaces of each of the plurality of tubes to the tape support surface.

* * * * *